US009776058B2

(12) United States Patent
Seluga et al.

(10) Patent No.: US 9,776,058 B2
(45) **Date of Patent: *Oct. 3, 2017**

(54) GOLF CLUB HEAD HAVING OPTIMIZED BALL SPEED TO CT RELATIONSHIP

(71) Applicant: Callaway Golf Company, Carlsbad, CA (US)

(72) Inventors: James A. Seluga, Carlsbad, CA (US); Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/385,549

(22) Filed: Dec. 20, 2016

(65) Prior Publication Data

US 2017/0100649 A1 Apr. 13, 2017

Related U.S. Application Data

(63) Continuation-in-part of application No. 15/051,361, filed on Feb. 23, 2016, which is a continuation-in-part (Continued)

(51) Int. Cl.
*A63B 53/06* (2015.01)
*A63B 53/04* (2015.01)

(52) U.S. Cl.
CPC .... *A63B 53/0466* (2013.01); *A63B 2053/045* (2013.01); *A63B 2053/0408* (2013.01);

(Continued)

(58) Field of Classification Search
CPC .. A63B 53/04; A63B 53/06; A63B 2053/0791

(Continued)

(56) References Cited

U.S. PATENT DOCUMENTS 3,652,094 A * 3/1972 Glover ..... A63B 53/08 473/337
5,489,097 A * 2/1996 Simmons ..... A63B 53/0487 473/326

(Continued)

FOREIGN PATENT DOCUMENTS

| | | |
|---|---|---|
| JP | 64-43278 | 2/1989 |
| JP | 3821516 | 9/2006 |
| JP | 2007267777 | 10/2007 |

OTHER PUBLICATIONS

Non-Final Office Action dated Apr. 20, 2017, U.S. Appl. No. 15/279,188.

(Continued)

*Primary Examiner* — William Pierce
(74) *Attorney, Agent, or Firm* — Rebecca Hanovice; Michael Catania; Sonia Lari

(57) ABSTRACT

A golf club head comprising a body and a plurality of stiffening members and satisfying the equation $V_{ballnorm} \geq 0.0356x+140.82$ is disclosed herein. The body comprises a face section, a sole section, and a crown or return section, and defines a hollow interior. Each of the plurality of stiffening members extends from the crown or return section to the sole section within the hollow interior to reduce stresses placed on the face section during impact with a golf ball. The stiffening members are all located within 1 inch of a rear surface of the face section measured along a plane normal to the center of the face, and are spaced a distance of 0.500 to 2.00 inch from one another within the hollow interior.

9 Claims, 7 Drawing Sheets

Related U.S. Application Data of application No. 14/997,199, filed on Jan. 15, 2016, which is a continuation-in-part of application No. 14/788,326, filed on Jun. 30, 2015, now Pat. No. 9,597,558, and a continuation-in-part of application No. 14/794,578, filed on Jul. 8, 2015, which is a continuation-in-part of application No. 14/755,068, filed on Jun. 30, 2015, now Pat. No. 9,623,302, which is a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned, and a continuation-in-part of application No. 14/622,606, filed on Feb. 13, 2015, now Pat. No. 9,345,936, which is a continuation of application No. 13/906,572, filed on May 31, 2013, now Pat. No. 8,956,244.

(60) Provisional application No. 61/665,203, filed on Jun. 27, 2012, provisional application No. 61/684,079, filed on Aug. 16, 2012.

(52) U.S. Cl.
CPC ..... *A63B 2053/0412* (2013.01); *A63B 2053/0437* (2013.01)

(58) Field of Classification Search
USPC ..... 473/324, 329, 330, 334, 340, 342, 338, 473/345
See application file for complete search history.

(56) References Cited

U.S. PATENT DOCUMENTS 5,766,094 A * 6/1998 Mahaffey ..... A63B 53/04 473/342
6,149,533 A * 11/2000 Finn ..... A63B 53/02 473/245
6,299,547 B1 10/2001 Kosmatka
6,332,847 B2 12/2001 Murphy et al.
6,383,090 B1 * 5/2002 O'Doherty ..... A63B 53/0466 473/329
6,435,978 B1 8/2002 Galloway et al.
6,475,100 B1 11/2002 Helmstetter et al.
6,524,197 B2 2/2003 Boone
6,852,038 B2 * 2/2005 Yabu ..... A63B 53/04 473/224
6,923,734 B2 * 8/2005 Meyer ..... A63B 53/047 473/336
6,979,270 B1 * 12/2005 Allen ..... A63B 53/04 473/290
7,066,835 B2 6/2006 Evans et al.
7,108,609 B2 * 9/2006 Stites ..... A63B 53/06 473/256
7,118,493 B2 * 10/2006 Galloway ..... A63B 53/02 473/224
7,166,041 B2 1/2007 Evans
7,351,161 B2 * 4/2008 Beach ..... A63B 53/0466 473/334
7,387,579 B2 * 6/2008 Lin ..... A63B 53/04 473/332
7,445,563 B1 11/2008 Werner
7,691,006 B1 * 4/2010 Burke ..... A63B 53/06 473/288
7,775,905 B2 * 8/2010 Beach ..... A63B 53/0466 473/256
7,914,393 B2 * 3/2011 Hirsch ..... A63B 53/0466 473/332
7,927,231 B2 * 4/2011 Sato ..... A63B 53/0466 473/334
8,523,702 B2 9/2013 Thomas et al.
8,540,587 B2 9/2013 Hirsch et al.
8,591,352 B2 11/2013 Hirano
8,608,585 B2 12/2013 Stites et al.
8,663,027 B2 * 3/2014 Morales ..... A63B 53/04 473/329
8,834,293 B2 9/2014 Thomas et al.
8,834,294 B1 * 9/2014 Seluga ..... A63B 53/04 473/338
8,956,244 B1 * 2/2015 Westrum ..... 473/338
9,067,110 B1 * 6/2015 Seluga ..... A63B 53/06
9,079,078 B2 7/2015 Greensmith et al.
9,180,349 B1 * 11/2015 Seluga ..... A63B 53/04
9,216,332 B1 * 12/2015 Ehlers ..... A63B 53/06
2010/0273565 A1 * 10/2010 Stites ..... A63B 53/04 473/282
2010/0304887 A1 * 12/2010 Bennett ..... A63B 53/0475 473/336
2010/0331101 A1 12/2010 Sato et al.
2011/0039634 A1 * 2/2011 Tavares ..... A63B 53/0466 473/335
2011/0152001 A1 * 6/2011 Hirano ..... A63B 53/0466 473/337
2011/0224017 A1 * 9/2011 Thomas ..... A63B 53/0466 473/332
2012/0094780 A1 * 4/2012 Slaughter ..... A63B 53/00 473/316
2012/0165115 A1 * 6/2012 Matsunaga ..... A63B 53/04 473/336
2012/0302367 A1 * 11/2012 Myrhum ..... A63B 53/0466 473/324
2013/0102410 A1 * 4/2013 Stites ..... A63B 53/0466 473/335
2013/0130829 A1 * 5/2013 Bennett ..... A63B 53/0466 473/337
2013/0130834 A1 * 5/2013 Stites ..... A63B 53/0466 473/346
2013/0184099 A1 * 7/2013 Stites ..... A63B 53/06 473/338
2013/0324299 A1 * 12/2013 Clausen ..... A63B 53/06 473/335
2015/0165280 A1 * 6/2015 Hebreo ..... A63B 53/0475 473/342

OTHER PUBLICATIONS

Final Office Action dated Feb. 21, 2017, U.S. Appl. No. 14/794,578.
Final Office Action dated Feb. 21, 2017, U.S. Appl. No. 14/997,199.
Final Office Action dated Mar. 24, 2017, U.S. Appl. No. 15/063,107.
Non-Final Office Action dated Jun. 28, 2016, U.S. Appl. No. 15/013,052.
Non-Final Office Action dated Jun. 29, 2016, U.S. Appl. No. 14/794,578.
Non-Final Office Action dated Apr. 21, 2016, U.S. Appl. No. 14/794,578.
Non-Final Office Action dated Jan. 14, 2016, U.S. Appl. No. 14/794,578.
Non-Final Office Action dated Jun. 28, 2016, U.S. Appl. No. 15/011,313.
Non-Final Office Action dated Jul. 12, 2016, U.S. Appl. No. 14/997,199.
Non-Final Office Action dated Jul. 11, 2016, U.S. Appl. No. 15/063,107.
Non-Final Office Action dated Jul. 22, 2016, U.S. Appl. No. 15/051,361.
Non-Final Office Action dated Dec. 1, 2016, U.S. Appl. No. 15/005,875.
Non-Final Office Action dated Apr. 17, 2017, U.S. Appl. No. 15/447,638.

(56) References Cited

OTHER PUBLICATIONS

Non-Final Office Action dated Apr. 17, 2017, U.S. Appl. No. 15/446,754.

* cited by examiner

GOLF CLUB HEAD HAVING OPTIMIZED BALL SPEED TO CT RELATIONSHIP

CROSS REFERENCES TO RELATED APPLICATIONS

The present invention is a continuation-in-part of U.S. patent application Ser. No. 15/051,361, filed on Feb. 23, 2016, which is a continuation-in-part of U.S. patent application Ser. No. 14/997,199, filed on Jan. 15, 2016, which is a continuation-in-part of U.S. patent application Ser. No. 14/788,326, filed on Jun. 30, 2015, and which is also a continuation-in-part of U.S. patent application Ser. No. 14/794,578, filed on Jul. 8, 2015, which is a continuation-in-part of U.S. patent application Ser. No. 14/755,068, filed on Jun. 30, 2015, which is a continuation-in-part of U.S. patent application Ser. No. 14/498,843, filed on Sep. 26, 2014, and issued on Feb. 16, 2016, as U.S. Pat. No. 9,259,627, which is a continuation-in-part of U.S. patent application Ser. No. 14/173,615, filed on Feb. 5, 2014, and issued on Nov. 10, 2015, as U.S. Pat. No. 9,180,349, which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, now abandoned, which claims priority to U.S. Provisional Patent Application Nos. 61/665,203, filed on Jun. 27, 2012, and 61/684,079, filed on Aug. 16, 2012, the disclosure of each of which is incorporated by reference in its entirety herein. U.S. patent application Ser. No. 14/997,199 is also a continuation-in-part of U.S. patent application Ser. No. 14/622,606, filed on Feb. 13, 2015, and issued on May 24, 2016, as U.S. Pat. No. 9,345,936, which is a continuation of U.S. patent application Ser. No. 13/906,572, filed on May 31, 2013, and issued on Feb. 17, 2015, as U.S. Pat. No. 8,956,244, the disclosure of each of which is incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with stress-reducing features connecting a crown portion with a sole portion via a hollow interior and disposed proximate a striking face section.

Description of the Related Art

The prior art discloses various golf club heads having interior structures. For example, Kosmatka, U.S. Pat. No. 6,299,547 for a Golf Club Head With an Internal Striking Plate Brace, discloses a golf club head with a brace to limit the deflection of the striking plate, Yabu, U.S. Pat. No. 6,852,038 for a Golf Club Head And Method of Making The Same, discloses a golf club head with a sound bar, Galloway, U.S. Pat. No. 7,118,493 for a Multiple Material Golf Club Head, discloses a golf club head with a composite aft body having an interior sound component extending upward from a sole section of a metal face component, Seluga et al., U.S. Pat. No. 8,834,294 for a Golf Club Head With Center Of Gravity Adjustability, discloses a golf club head with a tube having a mass for adjusting the CG of a golf club head, and Dawson et al., U.S. Pat. No. 8,900,070 for a Weighted Golf Club Head discloses a golf club head with an interior weight lip extending from the sole towards the face. However, the prior art fails to disclose an interior structure that increases ball speed through reducing stress in the striking face section at impact, with a minimal increase in mass to the golf club head.

BRIEF SUMMARY OF THE INVENTION

The golf club head comprises interior structures connecting a crown section to a sole section to reduce the stress in a striking face section during impact with a golf ball. In some embodiments, the interior structures are hollow tubes or solid rods composed of a titanium alloy.

One aspect of the present invention is a golf club head comprising a body comprising a striking face section, a sole section extending from a lower edge of the striking face section, and a crown section extending from an upper edge of the striking face section, the striking face section, sole section, and crown section defining a hollow body interior, and at least one stiffening member disposed within the hollow body interior and extending from the crown section to the sole section, wherein the striking face section comprises a rear face surface facing the hollow body interior, wherein the at least one stiffening member is located no more than 1 inch from the rear face surface along a vertical plane extending through the face center perpendicular to the striking face section, wherein no portion of the at least one stiffening member makes contact with the striking face section, wherein the golf club head satisfies the equation $V_{ballnorm} \geq 0.0356x+140.82$, and wherein $$V_{ballnorm} = \frac{m_h v_{inh} + m_h v_{inh} \left[ \frac{v_{cr}}{v_{cin}} \left(1 + \frac{m_b}{m_c}\right) + \frac{m_b}{m_c} + \frac{v_{br}}{v_{bin}} \left(1 + \frac{m_b}{m_p}\right) + \frac{m_b}{m_p} - 0.822 \right]}{m_h + m_b}.$$

In a further embodiment, the golf club head may satisfy the equation $V_{ballnorm} \geq 0.0356x+141.19$.

In some embodiments, the at least one stiffening member may comprise first and second stiffening members, the first stiffening member may extend approximately parallel with the second stiffening member, and the first stiffening member may be spaced a distance of 0.75 to 1.50 inch from the second stiffening member. In a further embodiment, each of the first and second stiffening members may comprise a structure selected from the group consisting of a solid rod and a hollow tube. In another, further embodiment, each of the first and second stiffening members may be a solid rod composed of a metal material selected from the group consisting of titanium alloy and steel. In an alternative embodiment, the at least one stiffening member may be located no more than 0.25 inch from the rear face surface along the vertical plane extending through the face center perpendicular to the striking face section. In a further embodiment, the at least one stiffening member may include an upper end proximate the crown section and a lower end proximate the sole section, the upper end may be spaced a first distance from the rear face surface, the lower end may be spaced a second distance from the rear face surface, and the first distance may be less than the second distance. In any of these embodiments, the golf club head may further comprise a cover piece, the sole section may include a plurality of cutouts, and the cover piece may be secured to the sole section and at least partially cover each of the plurality of cutouts. Also in any of these embodiments, the golf club head may comprise a crown insert, the crown section may comprise an upper opening, and the crown insert may cover the upper opening.

Another aspect of the current invention is golf club head comprising a metal body comprising a striking face section, a sole section extending from a lower edge of the striking face section, and a return section extending from an upper edge of the striking face section, the return section and sole section defining an upper opening, and the striking face section, sole section, and return section defining a hollow body interior, and first and second stiffening members disposed within the hollow body interior and extending from the return section to the sole section, wherein each of the first and second stiffening members is a solid metal rod, wherein no portion of either the first or second stiffening member makes contact with the striking face section, wherein the golf club head satisfies the equation $V_{ballnorm} \geq 0.0356x + 140.82$, and wherein $$V_{ballnorm} = \frac{\frac{m_h v_{inh} + m_h v_{inh}}{\left[\frac{v_{cr}}{v_{cin}}\left(1 + \frac{m_b}{m_c}\right) + \frac{m_b}{m_c} + \frac{v_{br}}{v_{bin}}\left(1 + \frac{m_b}{m_p}\right) + \frac{m_b}{m_p} - 0.822\right]}}{m_h + m_b}.$$

In a further embodiment, the golf club head may comprise a crown insert that may be permanently affixed to the body to close the upper opening. In some embodiments, the crown insert may be composed of a carbon composite material, and each of the first and second stiffening members may be integrally cast with the body.

In another embodiment, the golf club head may comprise a carbon composite cover piece, the sole section may comprise at least one cutout, and the cover piece may be permanently affixed to the sole section to cover the at least one cutout. In yet another embodiment, each of the first and second stiffening members may have a length of 1.00 inch to 2.50 inches, the first stiffening member may extend approximately parallel with the second stiffening member, and the first stiffening member may be spaced a distance of 0.500 to 2.00 inch from the second stiffening member. In still another embodiment, the striking face section may comprise a face center and a rear face surface, and each of the first and second stiffening members may be located no more than 0.500 inch from the rear face surface along a vertical plane extending through the face center perpendicular to the striking face section.

Yet another aspect of the present invention is a golf club head comprising a metal body comprising a striking face section, a sole section extending from a lower edge of the striking face section, a return section extending from an upper edge of the striking face section, and an aft end opposite the striking face section, the return section and sole section defining an upper opening, and the striking face section, sole section, and return section defining a hollow body interior, first and second stiffening members disposed within the hollow body interior and extending from the return section to the sole section, and a carbon composite crown insert permanently affixed to the body to close the upper opening, wherein each of the first and second stiffening members is located closer to the striking face section than to the aft end within the hollow body interior, wherein the golf club head has a volume of 420 cubic centimeters to 470 cubic centimeters, wherein the golf club head satisfies the equation $V_{ballnorm} \geq 0.0356x + 141.19$, and wherein $$V_{ballnorm} = \frac{\frac{m_h v_{inh} + m_h v_{inh}}{\left[\frac{v_{cr}}{v_{cin}}\left(1 + \frac{m_b}{m_c}\right) + \frac{m_b}{m_c} + \frac{v_{br}}{v_{bin}}\left(1 + \frac{m_b}{m_p}\right) + \frac{m_b}{m_p} - 0.822\right]}}{m_h + m_b}.$$

In some embodiments, the first stiffening member may comprise an upper end proximate the return section and a lower end proximate the sole section, the upper end may be spaced a first distance from the striking face section, and the lower end may be spaced a second distance from the striking face section that is greater than the first distance. In a further embodiment, the first distance is 0.120 inch may be 0.150 inch, and the second distance may be 0.180 inch to 0.210 inch. In another embodiment, each of the first and second stiffening members may have a length of 1.00 inch to 2.50 inches, the first stiffening member may extend approximately parallel with the second stiffening member, and the first stiffening member may be spaced a distance of 0.75 inch to 1.50 inch from the second stiffening member.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
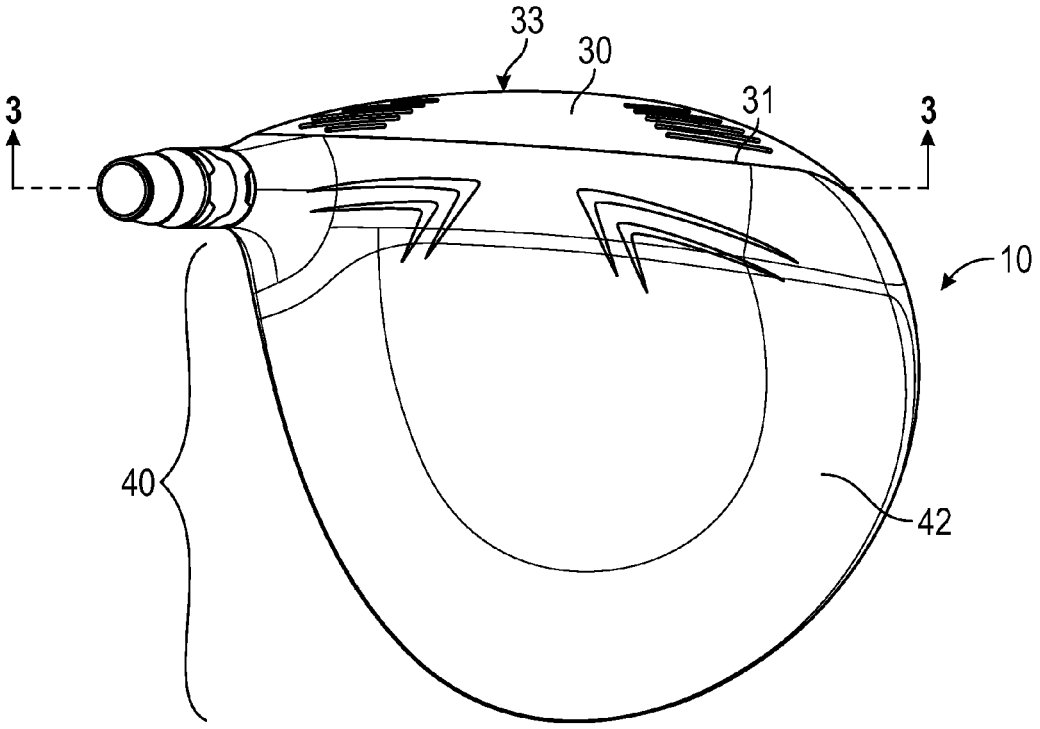
FIG. 1 is a top elevational view of the preferred embodiment of the golf club head of the present invention.
Figure 2:
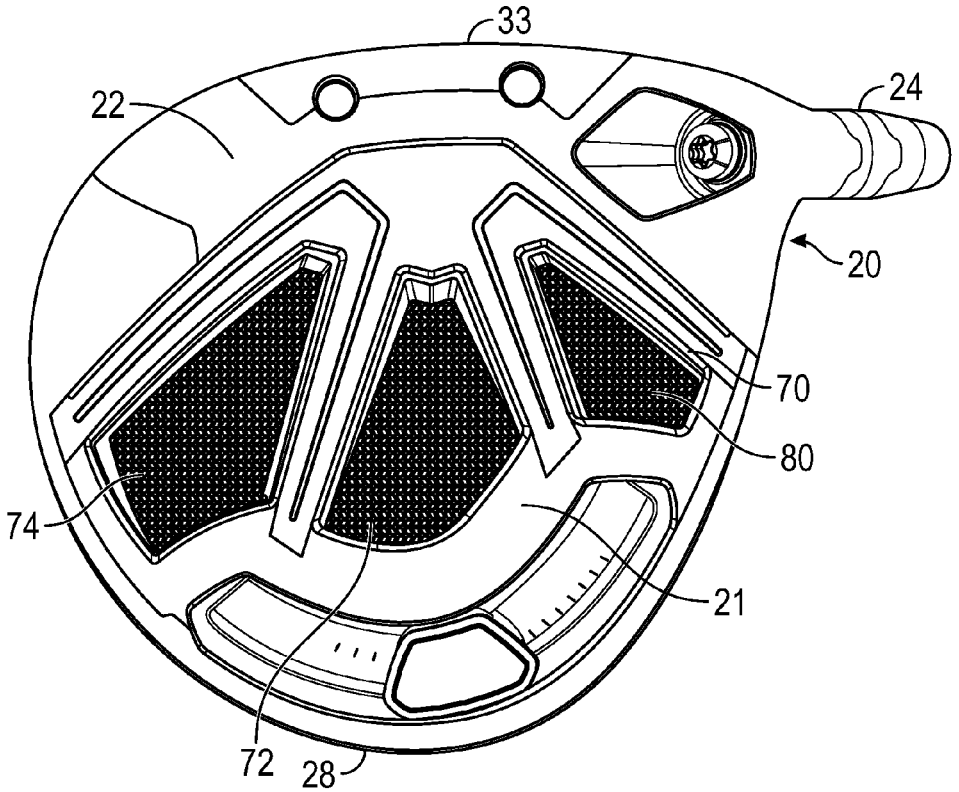
FIG. 2 is a sole elevational view of the golf club head shown in FIG. 1.

As shown in FIGS. 1-8, a preferred embodiment of the golf club head 10 of the present invention is generally designated. The golf club head 10 includes a body 20 having a striking face section 30 with a face center 34, a return section 32 extending rearwards away from an upper edge 31 of the striking face section 30, sole section 22 extending rearwards away from a lower edge 33 of the striking face section 30, a hosel 24 for engaging a shaft, a heel end 23, a toe end 25, an upper opening 26, a hollow interior 27, and an aft end 28. A crown section 40 is comprised of the return section 32 and a crown insert 42 that is placed over the upper opening 26 to enclose the hollow interior 27. The body 20 also includes three cutouts 70, 72, 74 in a center area 21 of the sole section 22, which are closed by a cover piece 80 having a density that is lower than the density of the material used to make the body 20. Each of the crown section 40 and cover piece 80 preferably is composed of a carbon composite material, while the body 20 is composed of a metal material such as titanium alloy or steel.

Within the hollow interior 27, two stiffening members 50, 52 extend from the sole section 22 upward to the return section 32 approximately parallel with the rear surface 36 of the striking face section 30 and with each other. In an alternative embodiment, the stiffening members 50, 52 may extend to the crown insert 42 instead; what is important is that the stiffening members 50, 52 connect the crown section 40 to the sole section 22 proximate the striking face section 30, without making contact with any portion of the striking face section 30, even when the striking face section 30 impacts a golf ball. The stiffening members 50, 52 must, in any event, be closer to the striking face section 30 than to the aft end 28 of the body 20.

Figure 3:
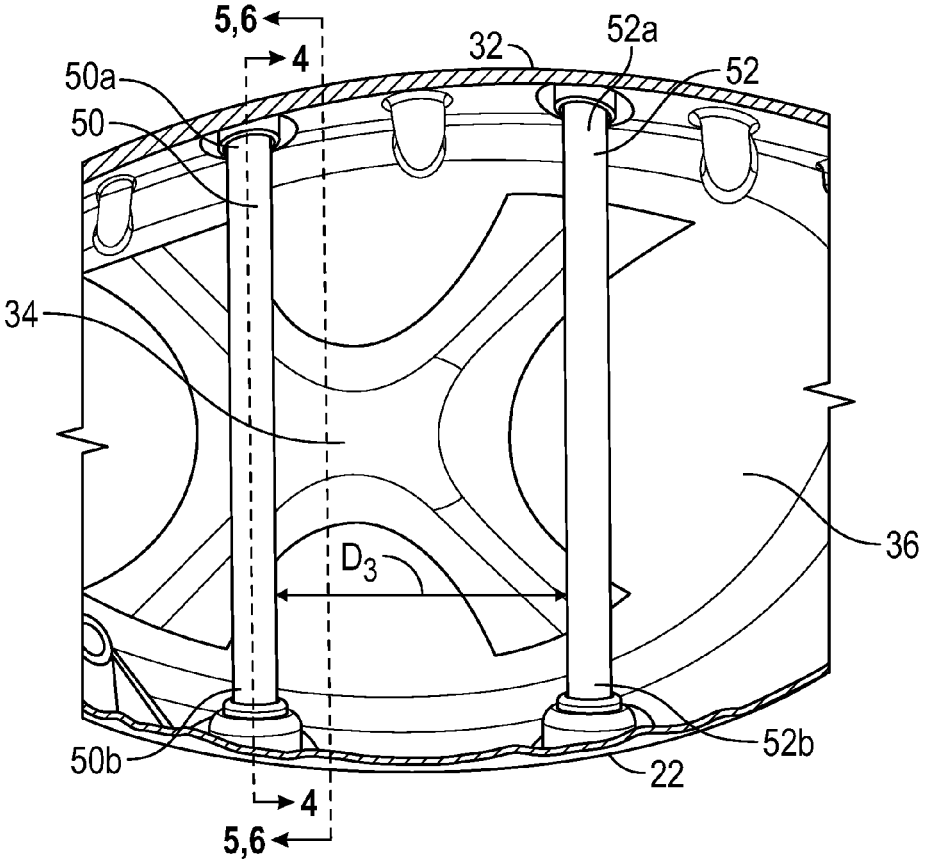
FIG. 3 is a cross-sectional view of the golf club head shown in FIG. 1 along lines 3-3.
Figure 4:
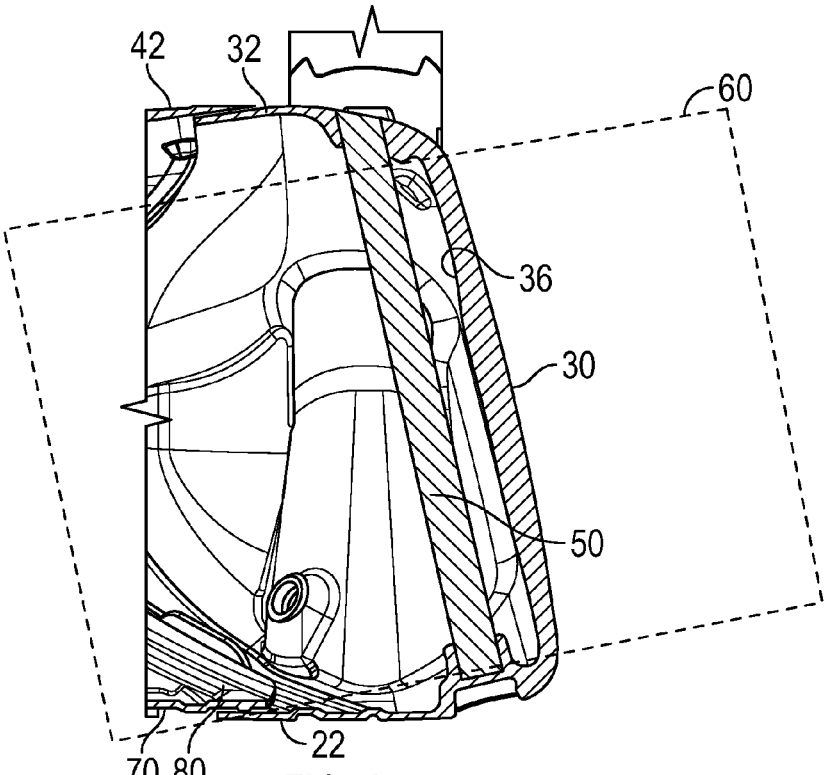
FIG. 4 is a cross-sectional view of the golf club head shown in FIG. 3 along lines 4-4.
Figure 5:
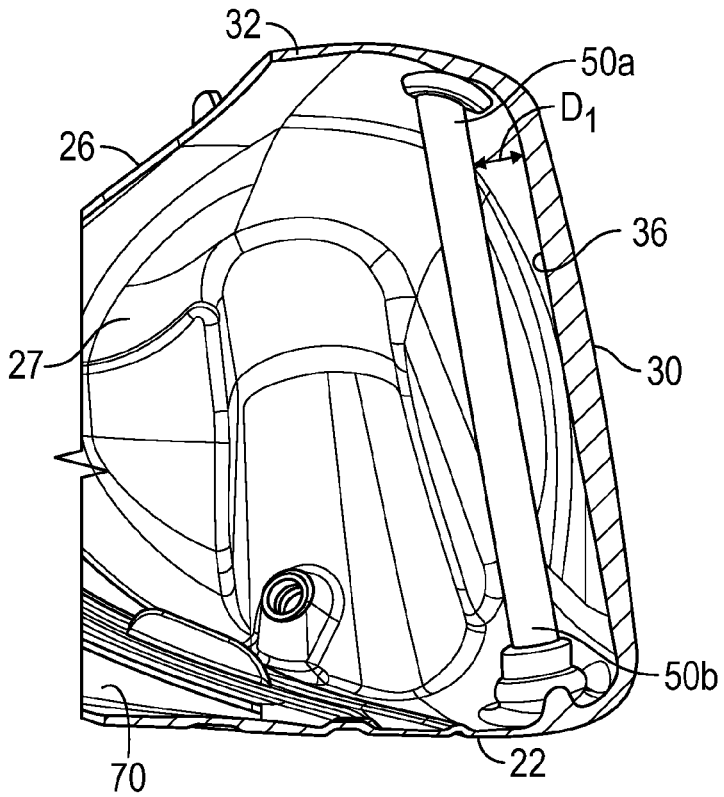
FIGS. 5-6 are cross-sectional views of the golf club head shown in FIG. 3 along lines 5-5 and 6-6, respectively.
Figure 6:
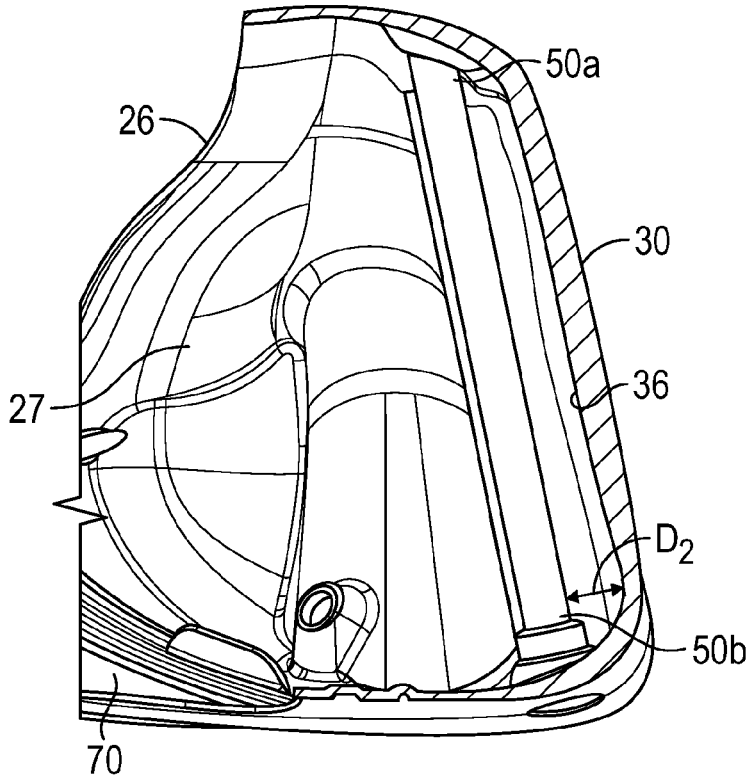
Figure 7:
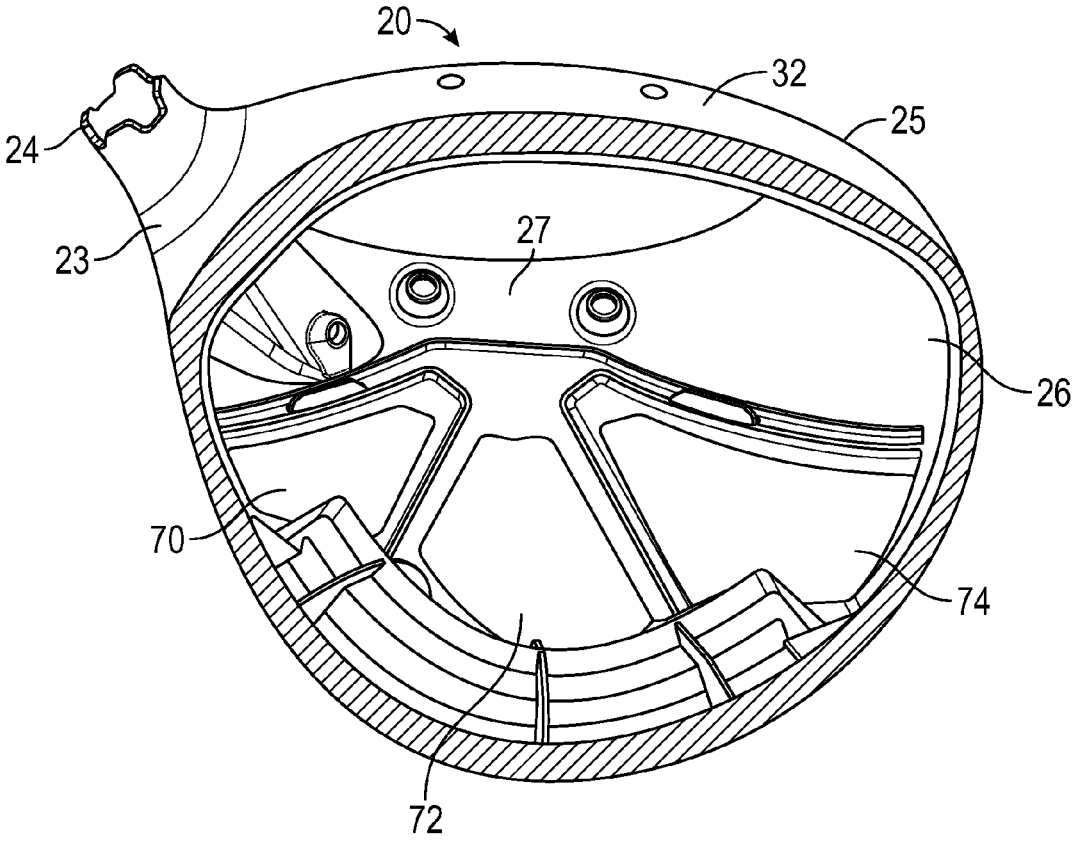
FIG. 7 is a top perspective view of the golf club head shown in FIG. 1 with its crown insert and sole cover piece removed.
Figure 8:
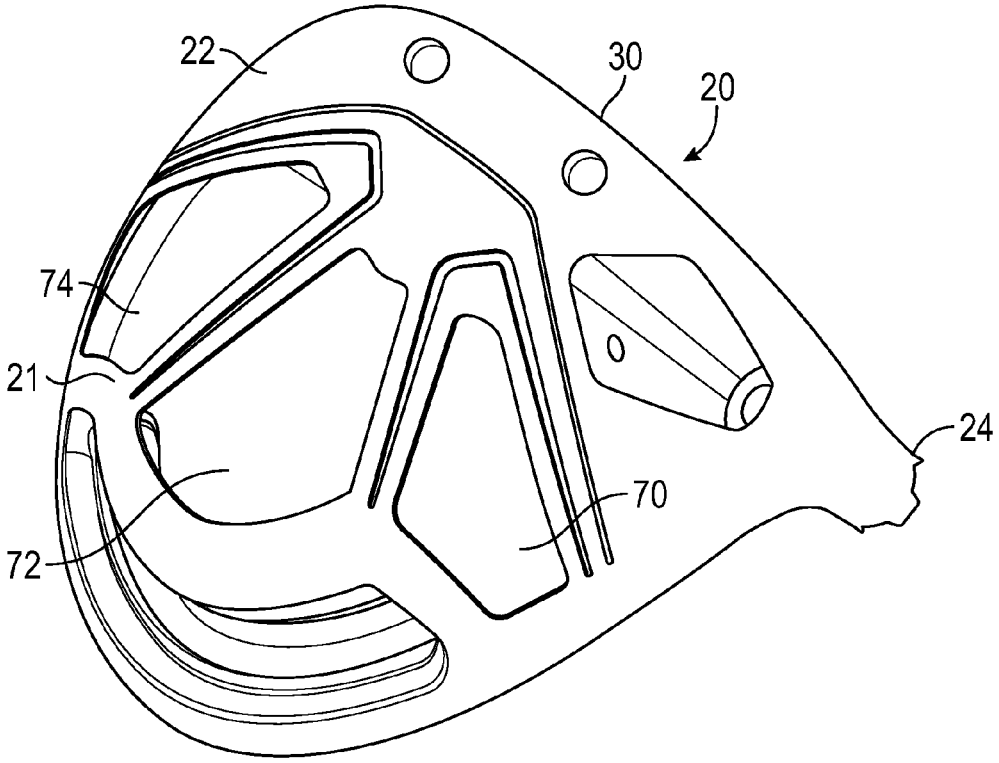
FIG. 8 is a sole perspective view of the embodiment shown in FIG. 7.

As shown in FIG. 3, the preferred embodiment has two stiffening members 50, 52, each of which is a solid rod composed of a lightweight, strong metal material such as titanium alloy or steel, though in an alternative embodiment the stiffening members 50, 52 each may be a hollow tube or other hollow structure made of a strong lightweight metal or a composite material. In another embodiment, the golf club head 10 may include both the solid rod and hollow types of stiffening members 50. The stiffening members 50, 52 preferably are co-cast with the body 20 using a wax molding process, though in alternative embodiments may be added after the body 20 is manufactured and secured to the body 20 via welding, brazing, solder, or adhesive, and/or mechanically.

In the preferred embodiment, each of the stiffening members 50, 52 has a diameter of 0.050 inch to 0.200 inch and a length of 1 to 2.5 inches. The stiffening members 50, 52 are both located within 1 inch of the rear surface 36 of the striking face section 30 measured along a vertical plane 60 extending through the face center 34 perpendicular to the striking face section 30. No portion of any stiffening member 50, 52 should be located outside of this 1-inch range; in fact, it is more preferable for each stiffening member 50, 52 to be located even closer to the rear surface 36 of the striking face section 30. In the preferred embodiment, the stiffening members are spaced 0.136 inch to 0.210 inch from the rear surface 36, with the upper end 50*a*, 52*a* of each stiffening member 50, 52 spaced a distance $D_1$ that is slightly closer to the rear surface 36 than the spacing $D_2$ of the lower end 50*b*, 52*b*. In the preferred embodiment, $D_1$ ranges from 0.120 inch to 0.150 inch, while $D_2$ ranges from 0.180 inch to 0.210 inch. The stiffening members 50, 52 are also spaced from one another by a distance $D_3$ of 0.500 to 2.00 inch, more preferably approximately 0.75 to 1.50 inch, and most preferably approximately 1.00 inch. This positioning of the stiffening members 50, 52 optimizes the normalized ball speed relationship to Characteristic Time (CT), as measured in μs by the U.S. Golf Association (USGA) CT test.

Figure 9:
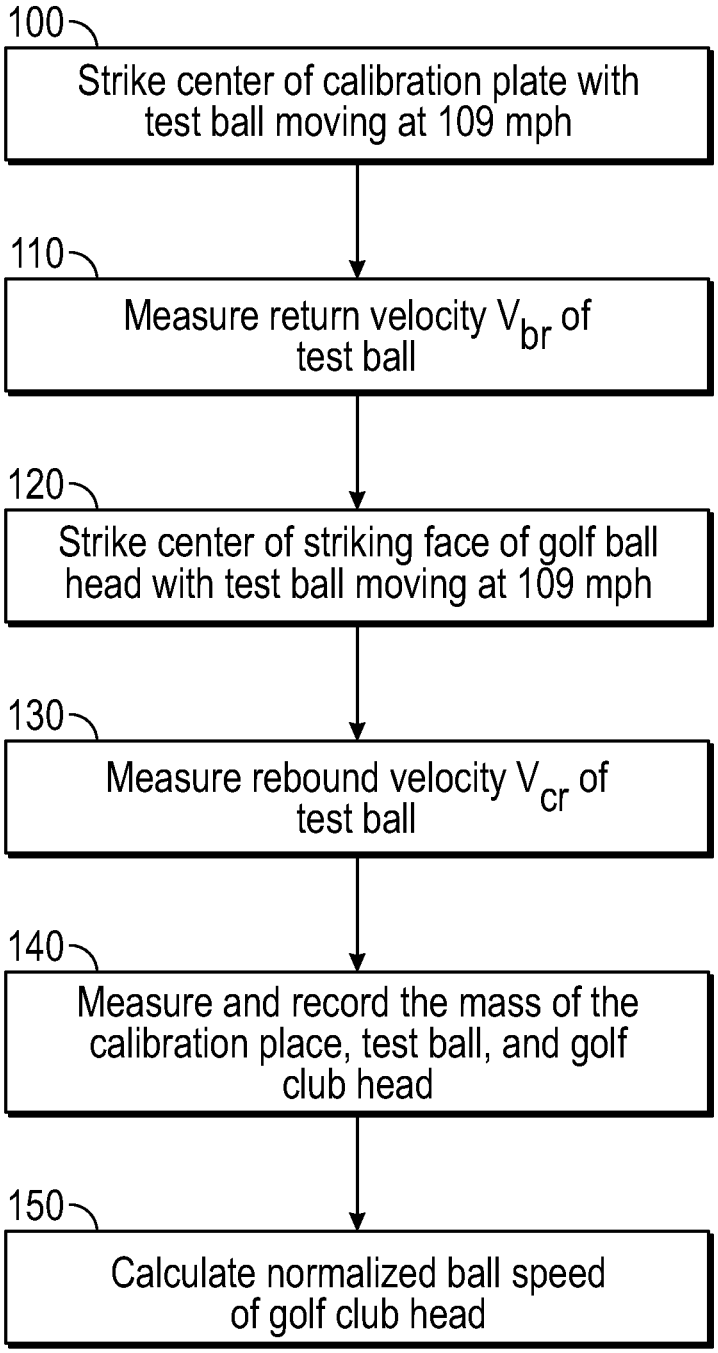
FIG. 9 is a flow chart describing how to calculate the normalized ball speed of a golf club head, including the embodiment shown in FIG. 1.

Normalized ball speed removes the variable effect of a golf club head's mass and loft, and the construction of a particular golf ball, from testing the speed of a golf ball upon impact with any given golf club head, including the golf club head 10 of the present invention; in other words, it allows an apples-to-apples comparison of golf club head performance. Normalized ball speed can be determined for a golf club head using the following steps, which are also outlined in the flow chart of FIG. 9.

Figure 10:
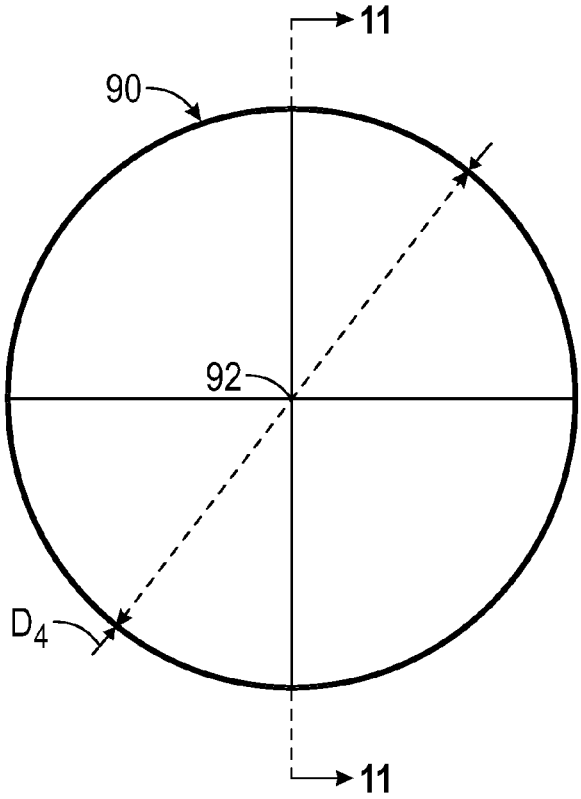
FIG. 10 is a top plan view of an exemplary calibration plate used to calculate normalized ball speed of a golf club head.
Figure 11:
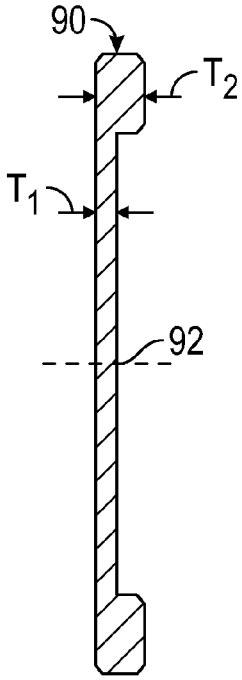
FIG. 11 is a cross-sectional view of the calibration plate shown in FIG. 10 along lines 11-11.

First, provide a titanium 6-4 calibration plate 90 with a mass of approximately 190 grams, a diameter $D_4$ of approximately 4 inches, a minimum thickness $T_1$ of approximately 0.100-0.150 inch, and a maximum thickness $T_2$ of approximately 0.200-0.400 inch, as shown in FIGS. 10 and 11, and strike the center 92 of the calibration plate with a test golf ball moving at approximately 109 mph (step 100). Measure the return velocity $V_{br}$ of the ball (step 110). Then, strike the same test golf ball, again traveling at approximately 109 mph, with the center 34 of the striking face section 30 of the golf club head 10 being assessed (step 120), and measure the rebound velocity $V_{cr}$ of the test golf ball (step 130). Next, measure and record the mass of the plate $m_p$, golf ball $m_b$, golf club head 10 $m_c$, measured head test ball in velocity (109 mph target) $V_{cin}$, measured plate test ball in velocity (109 mph target) $V_{bin}$, measured head test ball return velocity $V_{cr}$, and measured plate test ball return velocity $V_{br}$ (step 140). Finally, calculate the normalized ball speed ($V_{ballnorm}$) using the following equation (step 150):

$$V_{ballnorm} = \frac{m_h v_{inh} + m_h v_{inh} \left[ \frac{v_{cr}}{v_{cin}} \left(1 + \frac{m_b}{m_c}\right) + \frac{m_b}{m_c} + \frac{v_{br}}{v_{bin}} \left(1 + \frac{m_b}{m_p}\right) + \frac{m_b}{m_p} - 0.822 \right]}{m_h + m_b}$$

In this equation, $V_{inh}$ is 100 and $m_h$ is 200.

Figure 12:
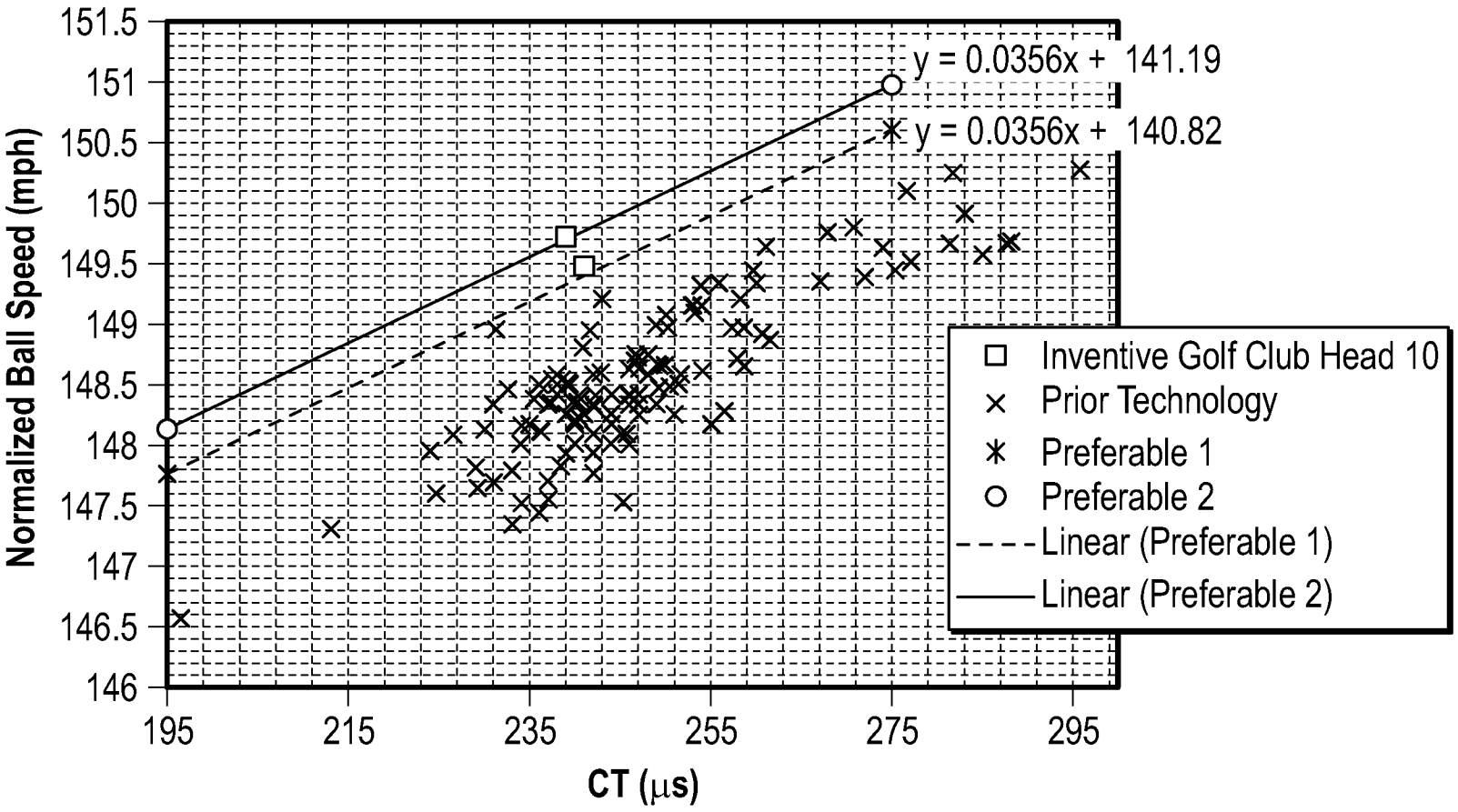
FIG. 12 is a graph showing the relationship between normalized ball speed (y-axis) and Characteristic Time (μs) (x-axis) of prior art golf club heads and the inventive golf club head described herein.

The golf club head 10 of the present invention has a $V_{ballnorm} \geq 0.0356x+140.82$, and more preferably a $V_{ballnorm} \geq 0.0356x+141.19$. The positioning of the stiffening members 50, 52 of the present invention allows the golf club head 10 to satisfy this equation; as shown in FIG. 12, prior art golf club heads, which do not include the stiffening member structure, fall well short of this performance metric.

In addition to optimizing the normalized ball speed of the golf club head 10, locating the stiffening members 50, 52 within the region of the golf club head 10 defined above has the greatest stress-reducing effect on the golf club head 10. If any of the stiffening members 50, 52 are placed more than 1 inch away from the rear surface 36 of the striking face section 30, they will not have a noticeable effect on the stress placed on the striking face section 30 when the golf club head 10 is in use, and will use discretionary mass without providing a significant performance benefit.

When the golf club head 10 is designed as a driver, it preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In the preferred embodiment, the golf club head 10 has a volume of approximately 450 cc to 460 cc.

The volume of the golf club head 10 will also vary between fairway woods (preferably ranging from 3-woods to eleven woods) with smaller volumes than drivers. When designed as a driver, the golf club head 10 preferably has a mass of no more than 215 grams, and most preferably a mass of 180 to 215 grams; when designed as a fairway wood, the golf club head 10 preferably has a mass of 135 grams to 200 grams, and preferably from 140 grams to 165 grams.

In each of the embodiments disclosed herein, the striking face section 30 preferably has a varying thickness such as that described in U.S. Pat. No. 7,448,960, for a Golf Club Head With Variable Face Thickness, which pertinent parts are hereby incorporated by reference. Other alternative embodiments of the thickness of the striking face section 30 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the striking face section 30 may have a uniform thickness.

In each of the embodiments disclosed herein, the body 20 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 20 is composed of 17-4 steel alloy. Additional methods for manufacturing the body 20 include forming the body 20 from a flat sheet of metal, super-plastic forming the body from a flat sheet of metal, machining the body 20 from a solid block of metal, electrochemical milling the body 20 from a forged pre-form, casting the body using centrifugal casting, casting the body 20 using levitation casting, and like manufacturing methods.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a metal body comprising a striking face section, a sole section extending from a lower edge of the striking face section, a return section extending from an upper edge of the striking face section, and an upper opening, the return section disposed between the striking face section and the upper opening, a crown insert permanently affixed to the body to close the upper opening and define a hollow body interior; and first and second stiffening members disposed within the hollow body interior and extending from the return section to the sole section, wherein the striking face section comprises a face center and a rear face surface facing the hollow body interior, wherein each of the first and second stiffening members is spaced no more than 0.250 inch from the rear face surface along a vertical plane extending through the face center perpendicular to the striking face section, wherein each of the first and second stiffening members is a solid metal rod, wherein each of the first and second stiffening members has a diameter of 0.050 inch to 0.200 inch and a length of 1.00 inch to 2.50 inches, wherein the first stiffening member extends approximately parallel with the second stiffening member, wherein the first stiffening member is spaced a distance of 0.500 to 2.00 inch from the second stiffening member, and wherein no portion of either the first or second stiffening member makes contact with the striking face section during impact with a golf ball.

2. The golf club head of claim 1, wherein the crown insert is composed of a carbon composite material.

3. The golf club head of claim 1, further comprising a carbon composite cover piece, wherein the sole section comprises at least one cutout disposed in a center area of the sole section, wherein the at least one cutout is an opening in communication with the hollow body interior, and wherein the cover piece is permanently affixed to a surface of the sole section so that a portion of the cover piece extends over and covers the at least one cutout.

4. A golf club head comprising:

a titanium alloy body comprising a striking face section, a sole section extending from a lower edge of the striking face section, a return section extending from an upper edge of the striking face section, an upper opening, and an aft end opposite the striking face section, the return section disposed between the striking face section and the upper opening;

a carbon composite crown insert permanently affixed to the body to close the upper opening and define a hollow body interior; and first and second stiffening members disposed within the hollow body interior and extending from the return section to the sole section, wherein the striking face section comprises a face center and a rear face surface, wherein each of the first and second stiffening members is located closer to the striking face section than to the aft end within the hollow body interior, wherein each of the first and second stiffening members is spaced no more than 0.250 inch from the rear face surface along a vertical plane extending through the face center perpendicular to the striking face section, wherein no portion of either the first or second stiffening member makes contact with the striking face section during impact with a golf ball, wherein the first stiffening member comprises an upper end proximate the return section and a lower end proximate the sole section, wherein the upper end is spaced a first distance from the striking face section, wherein the lower end is spaced a second distance from the striking face section that is greater than the first distance, and wherein the golf club head has a volume of 420 cubic centimeters to 470 cubic centimeters.

5. The golf club head of claim 4, wherein the first distance is 0.120 inch to 0.150 inch, and wherein the second distance is 0.180 inch to 0.210 inch.

6. The golf club head of claim 4, wherein each of the first and second stiffening members has a length of 1.00 inch to 2.50 inches, wherein the first stiffening member extends approximately parallel with the second stiffening member, and wherein the first stiffening member is spaced a distance of 0.75 inch to 1.50 inch from the second stiffening member.

7. The golf club head of claim 4, wherein each of the first and second stiffening members has a diameter of 0.050 inch to 0.200 inch.

8. The golf club head of claim 4, further comprising a carbon composite sole cover piece, wherein the sole section comprises at least one cutout disposed in a center area of the sole section, wherein the at least one cutout is an opening in communication with the hollow body interior, and wherein the sole cover piece is permanently affixed to a surface of the sole section so that a portion of the sole cover piece extends over and covers the at least one cutout.

9. The golf club head of claim 1, wherein the golf club head is a driver having a volume of 420 to 470 cubic centimeters.

* * * * *